US006208682B1

(12) United States Patent
Archenholtz et al.

(10) Patent No.: US 6,208,682 B1
(45) Date of Patent: Mar. 27, 2001

(54) CHANNEL INDUCTOR AND MELT FURNACE COMPRISING SUCH CHANNEL INDUCTOR

(75) Inventors: Åke Archenholtz; Jan Bostedt; Arne Löfgren; Gote Tallback; Saeid Ebrahim; Alf Lundström, all of Västerås (SE)

(73) Assignee: ABB AB, Vasteras (SE)

( * ) Notice: Subject to any disclaimer, the term of this patent is extended or adjusted under 35 U.S.C. 154(b) by 0 days.

(21) Appl. No.: 09/446,173

(22) PCT Filed: May 29, 1998

(86) PCT No.: PCT/SE98/01031

§ 371 Date: May 9, 2000

§ 102(e) Date: May 9, 2000

(87) PCT Pub. No.: WO98/58220

PCT Pub. Date: Dec. 23, 1998

(30) Foreign Application Priority Data

Jun. 18, 1997 (SE) ..... 9702334

(51) Int. Cl.[7] ..... H05B 6/16

(52) U.S. Cl. ..... 373/159; 373/162

(58) Field of Search ..... 373/159, 160, 373/161, 162, 163

(56) References Cited

U.S. PATENT DOCUMENTS

| | | | | |
|---|---|---|---|---|
| 1,598,236 | * | 8/1926 | Brayton, Jr. | 373/161 |
| 2,383,384 | * | 8/1945 | Harris, Jr. | 373/161 |
| 2,805,271 | * | 9/1957 | Lang | 373/161 |
| 3,100,237 | * | 8/1963 | Rydinger et al. | 373/161 |
| 3,412,195 | * | 11/1968 | Mumper | 373/155 |
| 4,201,882 | * | 5/1980 | Kolotilo et al. | 373/138 |
| 4,611,338 | * | 9/1986 | Lillicrap | 373/161 |
| 5,134,629 | * | 7/1992 | Cullan | 373/162 |

* cited by examiner

*Primary Examiner*—Tu Ba Hoang
(74) *Attorney, Agent, or Firm*—Jenkens & Gilchrist, A Professional Corporation

(57) ABSTRACT

A channel inductor and a furnace for melting, holding or refining metal. The channel inductor has a closed-loop core, a primary winding arranged around the core and a refractory lining in which the winding and core is partly enclosed and in which an inductor channel is formed. The channel inductor also has a detector to detect metal penetration of the refractory lining.

19 Claims, 2 Drawing Sheets

CHANNEL INDUCTOR AND MELT FURNACE COMPRISING SUCH CHANNEL INDUCTOR

TECHNICAL FIELD

The present invention relates to a channel inductor and to a furnace for melting, holding or refining of metal comprising such channel inductor.

BACKGROUND ART

A channel inductor is an electric device for melting and holding of metal. The inductor comprises a first primary winding, e.g. a multi-turn coil wound around a magnetic core. Around this core and the coil is a channel, normally called inductor channel, arranged. The channel opens at both its ends into a furnace vat. The inductor and the channel is normally contained in a removable inductor housing such that the inductor can be replaced without the need to reline the complete furnace vat.

The inductor channel, which during operation is filled with molten metal, constitutes a closed circuit. As the primary winding during operation is fed with an alternating current the melt in the inductor channel acts as a short-circuited secondary winding of a transformer. Power is thus induced in the melt which is heated and a flow pattern is developed in the channel. Due to the good stirring effect provided by the inductor a good homogenization as to temperature and composition will be achieved in the melt rendering this type of furnace suitable for many type of refining and alloying treatments. However the flow pattern generated in the channel, which normally is a two-loop flow over the channel cross-section, might also create erosion of the lining in the inductor or in some cases deposition of refining agents, solid particulate matter formed in the melt or other particles on the walls in the inductor channel resulting in a clogging of the channel. Such clogging will disturb the flow in the channel and thus the efficiency of the inductor.

A channel inductor is normally equipped with a cooling jacket for cooling of both the housing and the coil. The cooling jacket is arranged within the refractory lining provided around the coil, i.e. between the coil and the inductor channel and will shield the coil from any moisture given off by the lining material during sintering of the lining but will also constitute a protective barrier or shield around the coil which any melt which happens to penetrate the lining have to pass. The cooling jacket will, however, cause substantial thermal and electric losses. These losses will show as the heating of the water passing through the cooling jacket. Today refractory lining is normally applied as dried masses which are formed around templates without any water-additions. As the masses contain essentially no added water and there is no longer a need to protect the coil from moisture in the refractory lining and the primary object of the cooling jacket is in installations using this type of linings to protect the coil from any metal penetrating through the lining. Thereby has it become advantageous to design a channel inductor without the cooling jacket, giving the following advantages;

- the inductive losses to the cooling jacket are eliminated;
- possibility to reduce the thermal losses by an increasing the distance from the hot melt to the cooling system comprised in the coil;
- possibility to increase the overall efficiency of the inductor;
- possibility to increase melt and/or superheat capacity; and reduced maintenance as the corrosion situation in the cooling jacket is eliminated as will all water couplings etc. and supply hoses or tubes for the cooling jacket.

The inductor and especially the coil must however be safe-guarded against melt penetrating through the lining and damaging the coil and also against excessive wear especially in cases with increased superheat or melt capacity which are likely to increase the temperature in the interface melt/refractory lining and possible also the flow rate in the inductor channel. It is also an object to reduce the thermal and mechanical stresses, which the lining around the coil is subjected to.

It is therefore the object of the present invention to provide a channel inductor with an improved thermal efficiency and reduced need for maintenance while maintaining or improving the operational safety. It is one object that the cooling jacket shall be removed but that the inductor still shall be safe guarded from damage to the coil due to metal penetration. That is any metal penetration shall be prevented to reach the inductor coil. Further it is also an object to improve the flow characteristics of the inductor channel to reduce wear and to improve the control of supplied electrical power to reduce depositions and clogging and also measures will taken reduce losses to the mechanical structure and cooling system.

SUMMARY OF THE INVENTION

The present invention provides a channel inductor which comprises a winding wound around a core, and a refractory lining, in which at least a part of the core and the coil are arranged enclosed and embedded and an inductor channel formed around and encircling the core in the refractory lining such that it when filled with melt constitutes a secondary winding. The channel inductor further includes detection means for detecting any melt penetration through the refractory lining arranged in the refractory lining between the coil and the inductor channel.

Preferably the winding is a multi-turn coil with conductors in the form of copper tubes in which water or other suitable coolant is flowing during operation. The core is preferably a laminated iron core which for installation purposes is divided. When assembled the core normally forms a four-legged square or rectangular core. A refractory lining mass are rammed or in other way formed around part of the core and coil after the core have been assembled and placed within a channel template. The used ramming mix preferably essentially free from water additions but can also be a cast lining with high water-additions provided the lining is dried before the coil is mounted. The coil, the core and the template are mounted in an inductor housing and positioned relative each other in a desired manner within the inductor housing. The housing is thereafter filled with the refractory mix. The refractory mix is rammed around the coil and the template in such a way that an inductor channel with openings at two ends is formed around the coil and the core.

According to an embodiment of the invention the inductor comprises detection means in the form of a detection wall or fire wall, such as a cylindrical tube-like wall made from a mesh or net of an electrically conductive material, such as a metal, arranged around the coil in the lining between the coil and the channel. The detection wall is connected to indication means for indicating any melt penetration into the lining as it reaches the detection wall. With the detection means will it also be possible to indicate other disturbances in the lining which are likely to affect the performance of the inductor, such as moisture in the refractory lining.

According to one preferred embodiment of the invention the inductor comprises detection means in which two walls are arranged in the refractory lining between the inductor channel and the coil. A first essentially cylindrical detection wall or fire wall is arranged at a suitable distance from the inductor channel. The fire wall is exhibits an open structure and comprises an electrically conductive material. Preferably the fire wall is backed on either side or both sides with a backing wall made from an electrically insulating material such as a material based on mica. The first or fire detection wall indicates any metal penetration reaching this far in the insulation. The first detection wall is placed at such a distance from the coil that metal penetration reaching the first wall do not constitute an immediate danger but the inductor can be taken out for relining and other suitable repair at a planned coming stop in the production. This first wall is also arranged to interact with a second wall to measure the resistance in the refractory lining between these two walls. By measuring the resistance in the refractory lining between these two walls it is possible to monitor the metal penetration to see if it continues beyond the first wall, should the resistance be reduced under a preset value the inductor is disconnected from its power supply. This measurement of the resistance can also be used for monitoring the condition of the lining and indicate the moisture in the lining. To high moisture content in the lining increases the risk for flash-over or leakage currents in the lining. The second wall is often made of a heavier gauge wire material and will thus provide reinforcement to the refractory lining.

To further reduce the risks of metal penetrating the lining improvements have according to the present invention been made aimed at reducing wear, deposition and clogging in the inductor channel, these improvements will also show in reduced energy consumption and is characterized by the features of additional claims. Other developments have reduced the electrical losses in the channel inductor and there some of the strains put on the lining.

According to one embodiment the inductor channel is designed according to the following criteria;

the width of the channel which exhibits an essentially oval or rectangular cross-section with a width to radial height ratio of 1.5 or larger;

the radial height shall vary along the channel;

and preferably shall the inner-wall of the channel in area between the two openings of the inductor channel show an angle across half the channel width that is 0 degrees at the openings and at least 30 degrees at a center point between the openings. A channel designed according to these criteria will exhibit an improved flow with essentially no zones of stagnation and dead-water in a cross-section at any point along the channel. Preferably the variation of the radial height shall comprise sectors where the height is increased alternating with sectors where the height is decreased. The change in relative height along the channel will along the whole channel length both exhibit sectors with increasing radial height and sectors with decreasing radial height. The changes shall over such a sector correspond to a change of the radial height with at least 25% within a sector of one-eight of the periphery of the channel. As essentially all zones of stagnation or dead-water is eliminated in the cross-section flow pattern in the channel the deposition and clogging is substantially reduced. The changes in the cross-section flow pattern will also substantially reduce wear.

According to another embodiment a similar improvement in flow characteristics and substantial reduction in deposition, clogging and wear is achieved by the use of thyristor-controlled power supply. The thyristor shall be in a mode controlling the pulse duration, i.e. a pulse-length modulation mode. The most frequently used way to control the power supply to an inductor is to use a tap- or step-transformer giving different voltages at different taps. Dependent on the power need the inductor is connected to a suitable voltage. Alternatively step-less power supply can be used, using an alternation between to voltage steps of the transformer. The duration of the connected time at the different voltages is control by a clock relay automatically switching between the steps to supply the desired average power. The use of a thyristor-controlled power supply offers a step-less control between zero and hundred percent of the rated power, but the normally used the phase angle firing mode will create transient overtones on the distribution net to which the inductor is connected. Therefore shall according to this embodiment of the invention a thyristor in a pulse-length modulation mode, i.e. a mode controlling the duration of the pulses, by controlling the number of complete cycles for which the thyristor is on and the number of complete cycles for which it is off. This frequent switching off and on of the power supply creates forces acting the flow in the channel which frequent changes between maximal during the on periods and zero during the off periods. This results in variations in the flow whereby stagnation zones and so called dead-water zones never develops. Hereby is deposition and clogging essentially eliminated and as the flow is constantly changing also a likely reduction in wear. Further the pulse-length is according to one embodiment chosen such that the flow-velocity during the on-periods exceeds a critical value where it tends to break loose any newly-deposited relatively loose bonded particles on the wall. By choosing a suitable length for the off-periods can further advantages be obtained as all non-metallic particles will show a tendency to float up and out of the channel during these period of reduced flow.

According to one further improved embodiment have the energy losses in the inductor been substantially reduced while at the same time improving the flow in the channel by the introduction of air-gaps in the mechanical structure supporting the refractory lining, the core and the coil, i.e. the inductor housing. The introduction of air-gaps or slits in the housing and other parts of the supporting structure will reduce the inductive losses in these parts and thereby increase the overall efficiency of the inductor.

BRIEF DESCRIPTION OF THE DRAWINGS

The invention shall be described more in detail while referring to examples of preferred embodiments shown in the drawings FIG. 1 shows an inductor that according to known art is arranged with a cooling-jacket outside the coil. FIG. 2 shows a inductor where the coil has been removed and two fire walls or detection walls have been introduced in the lining to safe guard the coil against any metal penetrating the lining reaching the coil.

FIG. 3 shows a cross-section of the channel, FIG. 4 show a cut through the inductor illustrating the variation in radial height along the channel according to one preferred embodiment. FIG. 5 illustrate the special configuration of the nozzle area according to one preferred embodiment.

DESCRIPTION OF PREFERRED EMBODIMENTS

Figure 1:
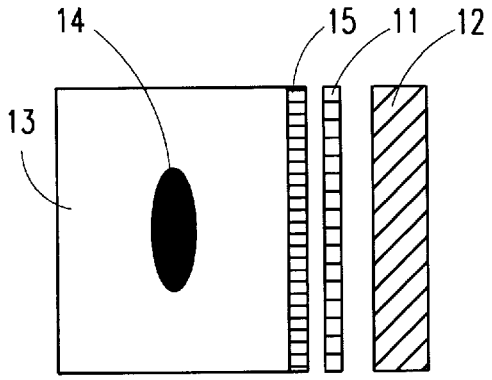
FIG. 1 (PRIOR ART)
FIGS. 1 and 2 show schematic sections of the refractory lining around the inductor channel and part of a multi-turn coil.
Figure 2:
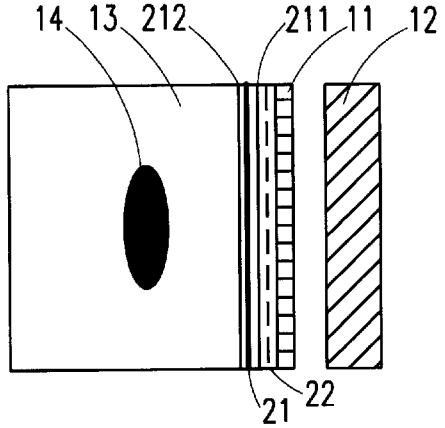

The channel inductor according to the prior art shown in FIG. 1 and the one according to one embodiment of the invention shown in FIG. 2 both comprises a multi-turn coil 11 with tube-conductors in the form of copper tubes in which water or other suitable coolant flows during operation. The coil 11 is wound around a core 12. The core 12 is a laminated iron core which for installation purposes is divided. When assembled the core 12 normally forms a four-legged square or rectangular core of which only part of one leg is shown in the figures. The coil 11 and core 12 is arranged in a refractory lining 13 in such a way that part of the core 12 and the coil 11 are enclosed and embedded in the lining 13. An inductor channel 14 is formed in the lining 13. The inductor channel 14 is formed to encircle the core 12 such that the channel 14 when filled with a metallic melt or other electrically conductive material constitutes a secondary winding. The inductor channel 14 is during operation filled with molten metal, constitutes a closed circuit. As the primary winding during operation is fed with an alternating current the melt in the inductor channel 14 acts as a short-circuited secondary winding of a transformer. Power is thus induced in the melt which is heated and made to flow in the channel 14. Due to the good stirring effect provided by the inductor a good homogenization as to temperature and composition will be achieved in the melt rendering this type of furnace suitable for many type of refining and alloying treatments. However the flow pattern generated in the channel 14, normally a two-loop flow over the channel cross-section as shown with the dotted lines in FIG. 3, might also create erosion of the lining in the inductor channel 14 or in some cases deposition of refining agents, solid particulate matter formed in the melt or other particles on the walls in the inductor channel resulting in a clogging of the channel 14. Such clogging of the channel 14 will disturb the flow in the channel 14 and thus the efficiency of the inductor. Channel inductors are normally equipped with a cooling jacket 15 as shown in FIG. 1. The purpose of the cooling jacket 15 is to provide cooling of both the housing 16 and the coil 11. The housing 16 is a structure for mechanical support arranged around the inductor. The cooling jacket 15 is arranged in the refractory lining 13 between the coil 11 and the inductor channel 14. The cooling jacket 15 is arranged to protect the coil 11 from any moisture given off by the lining material during sintering of the lining but will also constitute a protective barrier or shield around the coil which any melt which happens to penetrate the lining have to pass. The cooling jacket 15 will, however, cause substantial thermal and electric losses. These losses will e.g. show as the heating of the water passing through the cooling jacket 15. Because of these losses has it become advantageous to design a channel inductor without the cooling jacket 15, giving the following advantages;

- the inductive losses to the cooling jacket are eliminated;
- possibility to reduce the thermal losses by an increasing the distance from the hot melt to the cooling system comprised in the coil;
- possibility to increase the overall efficiency of the inductor;
- possibility to increase melt and/or superheat capacity; and
- reduced maintenance as the corrosion situation in the cooling jacket is eliminated as will all water couplings etc. and supply hoses or tubes for the cooling jacket.

The inductor and especially the coil 11 must however be safe-guarded against melt penetrating through the lining and damaging the coil and also against excessive wear especially in cases with increased superheat or melt capacity which are likely to increase the temperature in the interface melt/refractory lining and possible also the flow rate in the inductor channel 14. The channel inductor shown in FIG. 2 is arranged without cooling jacket but with two fire walls 22, 22 to safe guard the inductor coil 11 from being reached by metal penetrating the lining. The fire walls are arranged to detect any melt penetration through the refractory lining 13 and placed in the refractory lining 13 between the coil 11 and the inductor channel 14. The first fire wall 21 or detection wall is essentially cylindrical and coaxially arranged around the coil 13 arranged at a suitable distance from the inductor channel 14. The fire wall 21 has an open structure and is made in electrically conductive material. The fire wall is backed on both sides with a sheet of mica insulation 211, 212. The first detection wall 21 or fire wall is arranged to indicate any metal penetration reaching this far in the lining 13 and is placed at such a distance from the coil 11 that metal penetration reaching the first wall 21 do not constitute an immediate danger but the inductor can be taken out for relining and other suitable repair at a planned coming stop in the production. This first wall 21 is also arranged to interact with the second wall 22 to measure the resistance in the refractory lining 13 between these two walls 21,22. By measuring the resistance in the refractory lining 13 between these two walls 21,22 it is possible to monitor the metal penetration to see if it continues beyond the first wall 21, should the resistance be reduced under a preset value the inductor is disconnected from its power supply. This measurement of the resistance can also be used for monitoring the condition of the lining 13 and especially to indicate any change in moisture content in the lining. To high moisture content in the lining increases the risk for flash-over or leakage currents in the lining. The second wall 22 is often made of a heavier gauge wire material and will thus provide reinforcement to the refractory lining 13.

Figure 3:
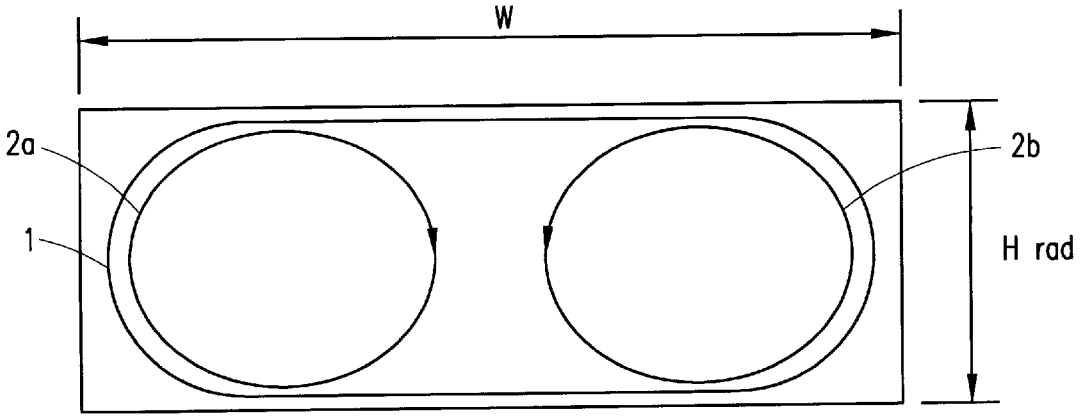
FIGS. 3, 4 and 5 illustrates the geometrical changes made to the inductor channel according to preferred embodiments of the invention.
Figure 4:
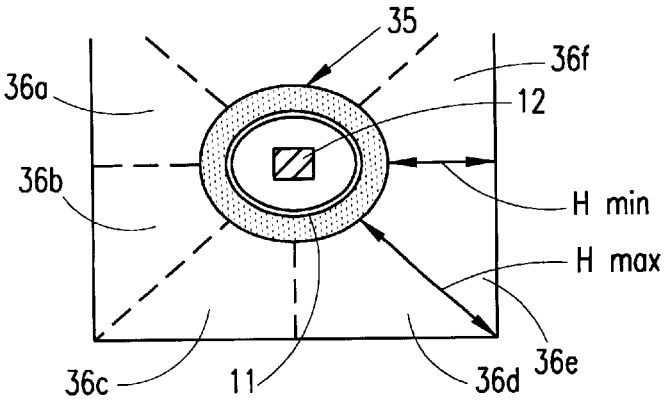
Figure 5:
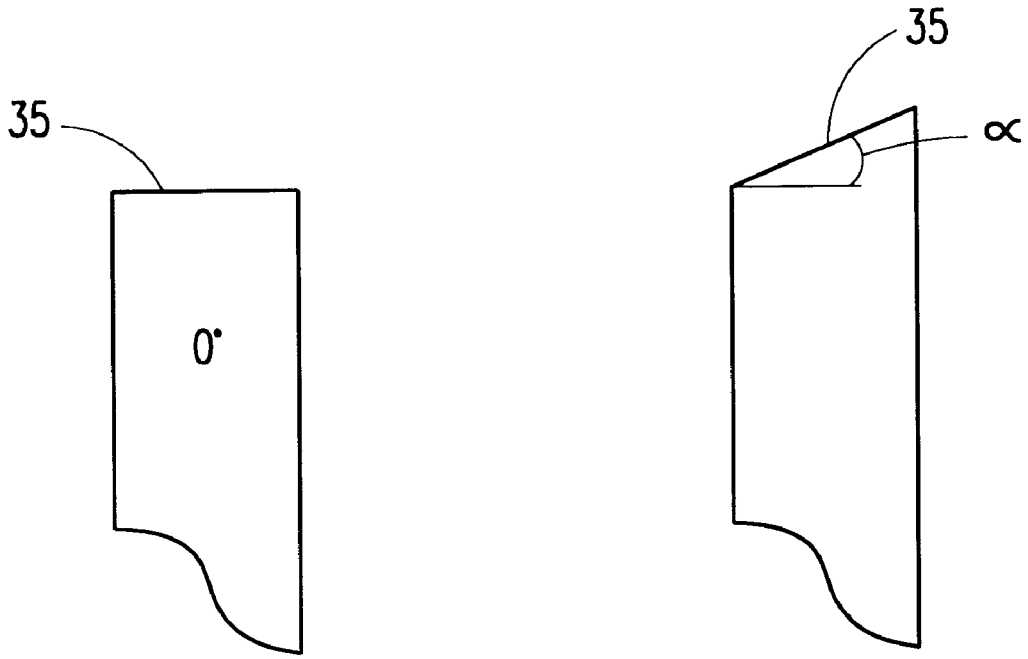

According to the embodiment of the inductor illustrated in FIGS. 3, 4 and 5 the inductor channel is designed according to the following criteria;

- the width W of the channel which exhibits an essentially oval or rectangular cross-section with a width to radial height ratio of 1.5 or larger, $W/H_{rad}$;
- the radial height, $H_{rad}$, shall vary along the channel;
- and preferably shall the inner-wall 35 of the channel in area between the two openings of the inductor channel show an angle a across half the channel width that is 0 degrees at the openings and at least 30 degrees at a center point between the openings. The channel designed according to this embodiment exhibit an improved flow with essentially no zones of stagnation and dead-water in a cross-section at any point along the channel as the two-loop flow pattern, the thin lined circles 2*a*,2*b* in FIG. 3, that normally is developed in a channel designed according to prior art is changed into a flow pattern exhibiting an essentially one-loop flow the thicker line 1, in FIG. 3. The variation in radial height $H_{rad}$ is accomplished with sectors where the height 36*a*, 36*c*, 36*e* is decreased alternating with sectors where the height is increased 36*b*,36*d*,36*f*. The change in relative height over such a sector correspond 36*a*, 36*b* 36*c*, 36*d* 36*e*, 36*f* which corresponds to one-eight of the periphery is at least 25%, i.e. the ratio $H_{max}/H_{min}$ is 1.25 or more. Essentially all zones of stagnation or dead-water is eliminated in the cross-section flow pattern in the channel 14 according to this embodiment thereby substantially reducing the deposition and clogging in the channel 14. The changes in the cross-section flow pattern will also substantially reduce wear in the channel 14.

What is claimed is:

1. A channel inductor comprising a primary winding that is arranged around a closed-loop core, wherein said primary winding and said closed-loop core are partly enclosed in a refractory lining and an inductor channel is formed in the refractory lining, said inductor channel is being such arranged in the refractory lining so that the inductor channel when filled with an electrically conductive material acts as a secondary winding, said channel inductor further includes detection means for detection of metal penetration of the refractory lining is arranged in the refractory lining between the inductor channel and the primary winding, and that said detection means exhibit openings and is made in an electrically conductive material.

2. A channel inductor according to claim 1, wherein said primary winding is a multi-turn coil.

3. A channel inductor according to claim 2, wherein said multi-turn coil comprises tube-conductors in which a coolant is arranged to flow during operation.

4. A channel inductor according to claim 1, wherein said closed-loop core is a laminated iron core.

5. A channel inductor according to claim 1, wherein said detection means comprises a cylindrical detection wall arranged in the refractory lining and encircling the primary winding.

6. A channel inductor according to claim 5, wherein said cylindrical detection wall comprises a metallic net or mesh.

7. A channel inductor according to claim 1, wherein said detection means comprises a cylindrical backing made in an electrically insulating material.

8. A channel inductor according to claim 5, wherein said detection means comprises measurement means for monitoring the resistance in the refractory lining between the cylindrical detection wall and earth.

9. A channel inductor according to claim 5, wherein said cylindrical detection wall includes a first detection wall and a second detection wall, wherein said second detection wall is arranged in the refractory lining between the first detection wall and the primary winding, wherein said primary winding is made in an electrically conductive material.

10. A channel inductor according to claim 9, wherein said detection means comprises measurement means for monitoring the resistance in the refractory lining between the first and the second detection walls.

11. A channel inductor according to claim 1, wherein said inductor channel is arranged with a width to radial height ratio $W/H_{rad}$ of 1.5 or more.

12. A channel inductor according to claim 1, wherein said inductor channel is arranged with a variation in radial height $H_{rad}$ along the channel.

13. A channel inductor according to claim 1, wherein said inductor channel is arranged with an inner-wall, which in the area between the openings of the inductor channel exhibits an angle $\alpha$ across half the width of the inductor channel that is 0 degrees at the openings and at least 30 degrees at a center point between the openings.

14. A channel inductor according to claim 1, further comprising a thyristor in a mode for controlling a pulse length duration is used to control the power supply to the inductor channel.

15. A channel inductor according to claim 1, wherein air gaps are arranged in a mechanical structure supporting the inductor channel to reduce the inductive losses in the support structure.

16. A melt furnace including a channel inductor comprising:

a refractory lining;

a closed-loop core;

a primary winding arranged around said closed-loop core, said primary winding and said closed-loop core are both partly enclosed in said refractory lining;

an inductor channel is formed in said refractory lining and is arranged in said refractory lining so that said inductor channel when filled with an electrically conductive material acts as a secondary winding; and a detector for detection of metal penetration of said refractory lining is arranged in said refractory lining between said inductor channel and said primary winding, said detector exhibits openings and is made in an electrically conductive material.

17. A method for improving thermal and overall efficiency within a melt furnace including a channel inductor comprising a primary winding that is arranged around a closed-loop core, wherein said primary winding and said closed-loop core are partly enclosed in a refractory lining and an inductor channel is formed in the refractory lining, said inductor channel is being such arranged in the refractory lining so that the inductor channel when filled with an electrically conductive material acts as a secondary winding, said method comprising the step of:

detecting metal penetration of the refractory lining using an electrically conductive metallic net or mesh exhibiting openings.

18. The method according to claim 17, further comprising the step of monitoring the resistance in said refractory lining.

19. The method according to claim 17, further comprising the step of controlling a power supply to provide a pulse length duration to the inductor channel.

* * * * *